US005863076A

United States Patent [19]

Warther

[11] Patent Number: 5,863,076

[45] Date of Patent: Jan. 26, 1999

[54] TIME TAGS WITH DATA STORAGE

[75] Inventor: Richard O. Warther, West Chester, Pa.

[73] Assignee: Vanguard Identification Systems, Inc., Exton, Pa.

[21] Appl. No.: 911,806

[22] Filed: Aug. 15, 1997

Related U.S. Application Data

[63] Continuation-in-part of Ser. No. 482,634, Jun. 7, 1995, Pat. No. 5,769,457.

[51] Int. Cl.[6] ..... B42D 15/00

[52] U.S. Cl. ..... 283/74; 283/82; 283/105; 283/904; 40/299; 40/634

[58] Field of Search ..... 283/904, 74, 82, 283/105, 109; 40/299, 330, 634

[56] References Cited

U.S. PATENT DOCUMENTS

| | | | |
|---|---|---|---|
| 2,256,399 | 9/1941 | MacHarg . | |
| 2,312,204 | 2/1943 | Weindel, Jr. . | |
| 2,326,939 | 8/1943 | Grafsland . | |
| 2,357,641 | 9/1944 | Evalt . | |
| 2,578,548 | 12/1951 | Histed . | |
| 2,812,601 | 11/1957 | Hines . | |
| 2,865,120 | 12/1958 | Hines . | |
| 3,130,509 | 4/1964 | Brooks . | |
| 3,152,901 | 10/1964 | Johnson . | |
| 3,583,317 | 6/1971 | Gibson . | |
| 3,676,644 | 7/1972 | Vaccaro et al. | 283/82 |
| 3,684,869 | 8/1972 | Reiter . | |
| 3,697,101 | 10/1972 | Loos et al. . | |
| 3,820,261 | 6/1974 | Beall, Jr. . | |
| 3,860,796 | 1/1975 | Wallace et al. | 283/82 |
| 3,902,262 | 9/1975 | Colegrove et al. | 283/82 |
| 4,271,352 | 6/1981 | Thomas . | |
| 4,306,433 | 12/1981 | Kelly . | |
| 4,521,981 | 6/1985 | Kasprzycki et al. . | |
| 4,536,013 | 8/1985 | Haghiri-therani et al. | 283/82 |
| 4,608,288 | 8/1986 | Spindler | 283/81 |
| 4,637,635 | 1/1987 | Levine . | |

(List continued on next page.)

FOREIGN PATENT DOCUMENTS

| | | |
|---|---|---|
| 2225001 | 10/1974 | France . |
| 2-265796 | 10/1990 | Japan . |
| WO 89/07052 | 8/1989 | WIPO . |

OTHER PUBLICATIONS

H. Bailey and B. Wray, Photographic Bar Code Labels, *Identical Journal*, Jan./Feb. 1988, pp. 16–19.

*Primary Examiner*—Willmon Fridie, Jr.
*Assistant Examiner*—Adesh Bhargava
*Attorney, Agent, or Firm*—Panitch, Schwarze Jacobs & Nadel, P.C.

[57] ABSTRACT

A printed sheet product is formed by a core of printable sheet material having a pair of opposing major planar sides. At least one side bears printing. A plurality of magnetizable stripes are laid down over at least one major side of the core in spaced parallel lines extending across the one major side of the core. Scoring extending sufficiently through the sheet product including the core and each of the magnetizable stripes to define a plurality of tag elements removable from the sheet. The tag elements are of an identical shape. Each tag element bears at least part of at least one of the magnetizable stripes and part of the printing. The scoring further defines a hole extending transversely through each removable tag element of the sheet. The printing includes a unique code in characters, bar codes or both. Labels bearing the same codes can be simultaneously prepared by the printing and scoring of the core and providing a pressure sensitive adhesive layer on the sheet product behind each label. The removable tag elements are elongated but other than rectangular in shape. All depicted removable tag elements vary in width along their length. Where each magnetizable stripe is positioned to extend across the width of the element, at least one stripe overlies the widest longitudinal end of the element. Where the magnetizable stripes are positioned to extend along the length of each removable tag element, the hole through the element is located in the widest longitudinal end of the element.

25 Claims, 4 Drawing Sheets

U.S. PATENT DOCUMENTS

| | | | |
|---|---|---|---|
| 4,637,712 | 1/1987 | Arnold et al. . | |
| 4,806,740 | 2/1989 | Gold et al. | 283/82 |
| 4,842,304 | 6/1989 | Jones . | |
| 4,854,610 | 8/1989 | Kwiatek . | |
| 4,863,196 | 9/1989 | Ohnishi et al. | 283/82 |
| 4,887,763 | 12/1989 | Sano . | |
| 4,889,749 | 12/1989 | Ohashi et al. | 283/74 |
| 4,904,853 | 2/1990 | Yokokawa . | |
| 4,978,146 | 12/1990 | Warther et al. . | |
| 4,995,642 | 2/1991 | Juszak et al. . | |
| 5,078,828 | 1/1992 | Marglin . | |
| 5,195,123 | 3/1993 | Clement | 283/74 |
| 5,356,717 | 10/1994 | Choki et al. | 283/82 |
| 5,439,255 | 8/1995 | McIntire et al. . | |
| 5,495,981 | 3/1996 | Warther . | |
| 5,720,158 | 2/1998 | Goade, Sr. . | |
| 5,743,567 | 4/1998 | Warther . | |

TIME TAGS WITH DATA STORAGE

CROSS-REFERENCE TO RELATED APPLICATION

This application is a continuation-in-part of U.S. Application Ser. No. 08/482,634 filed Jun. 7, 1995, now U.S. Pat. No. 5,769,457.

BACKGROUND OF THE INVENTION

This invention relates to printed sheet products and, in particular, to sets of uniquely encoded, printed tags.

A substantial market has developed in recent years for individually manufactured, individually encoded transaction cards and tags. These are issued by stores and other businesses for such uses as membership verification, individual identification, etc. Transaction cards and/or tags typically bear a code in a printed bar format to permit automatic machine scanning. Sometimes labels are supplied with each card and/or tag and bear the same individual code number as the card/tag for attachment to application enrollment forms, membership lists, etc. Sometimes forms are supplied together with such tags. Their relatively low manufacturing cost in comparison to other forms of identification, e.g. embossed, magnetic stripe equipped credit and transaction cards and "smart" cards have led to their greater acceptance and more widespread use, especially where customer convenience is sought and the need for security with respect to the cards is relatively low.

BRIEF SUMMARY OF THE INVENTION

In one aspect, the invention is a printed sheet product comprising a core of printable sheet material having a pair of opposing major planar sides, at least one major side bearing printing; a plurality of magnetizable stripes laid down over at least one major side of the core in spaced parallel lines extending across the one major side of the core; scoring extending sufficiently through the sheet product including the core and each of the magnetizable stripes to define a plurality of tag elements removable from the sheet product, each tag element bearing part of at least one of the magnetizable stripes and printing; a portion of the printing on each of the removable tag elements being identical to printing on each other tag element of the sheet and another portion of the printing of each tag element being different from the printing on at least one other tag element of the sheet.

In another aspect, the invention is a printed sheet product comprising: a core of printable sheet material having a pair of opposing major planar sides, at least one side bearing printing; a plurality of magnetizable stripes laid down over at least one major side of the core in spaced parallel lines extending across the one major side of the core; scoring extending sufficiently through the sheet product including the core and each of the magnetizable stripes to define a plurality of tag elements removable from the sheet, the plurality of tag elements being of an at least similar shape, each tag element bearing at least part of at least one of the magnetizable stripes and part of the printing, and the scoring further defining an opening with a closed perimeter extending transversely through each removable tag element of the sheet.

In yet another aspect, the invention is a printed sheet product comprising: a core of printable sheet material having a pair of opposing major planar sides, at least one major side bearing printing; a plurality of magnetizable stripes overlying at least one major side of the core in spaced parallel lines extending entirely across the one major side of the core; scoring extending sufficiently through the sheet product including the core and each of the magnetizable stripes to define a plurality of separate, individual tag elements removable from the sheet, the plurality of tag elements being of an at least similar shape other than rectangular, each tag element bearing at least part of at least one of the magnetizable stripes and part of the printing, the printing on each removable tag element including at least a machine readable code and the codes printed on the plurality of tag elements removable from the sheet product being different on at least two of the tag elements of the plurality.

In yet another aspect of the invention is a printed sheet product comprising: a core of printable sheet material having a pair of opposing major planar sides, at least major side bearing printing in the form of a plurality of sets of printed fields; scoring extending through the sheet product sufficiently to define at least a plurality of elements removable from the sheet product, each removable element including a set of the printed fields; each removable element of the plurality being only generally quadrilateral in shape with a width and a length longer than the width, each removable element having a pair of opposing, spaced apart long sides and a pair of opposing, spaced apart short sides, each of the short sides being shorter in length than each of the long sides, spacing between the pair of long sides changing along the length of the element whereby each element has a narrower width portion and a wider width portion; and the scoring further defining a closed perimeter opening through each removable element, the closed perimeter opening in each removable element being located more than one-half inch from at least one of the sides of the element.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Related U.S. patent application Ser. No. 08/482,634 filed Jun. 7, 1995, is incorporated by reference herein in its entirety.

Figure 1:
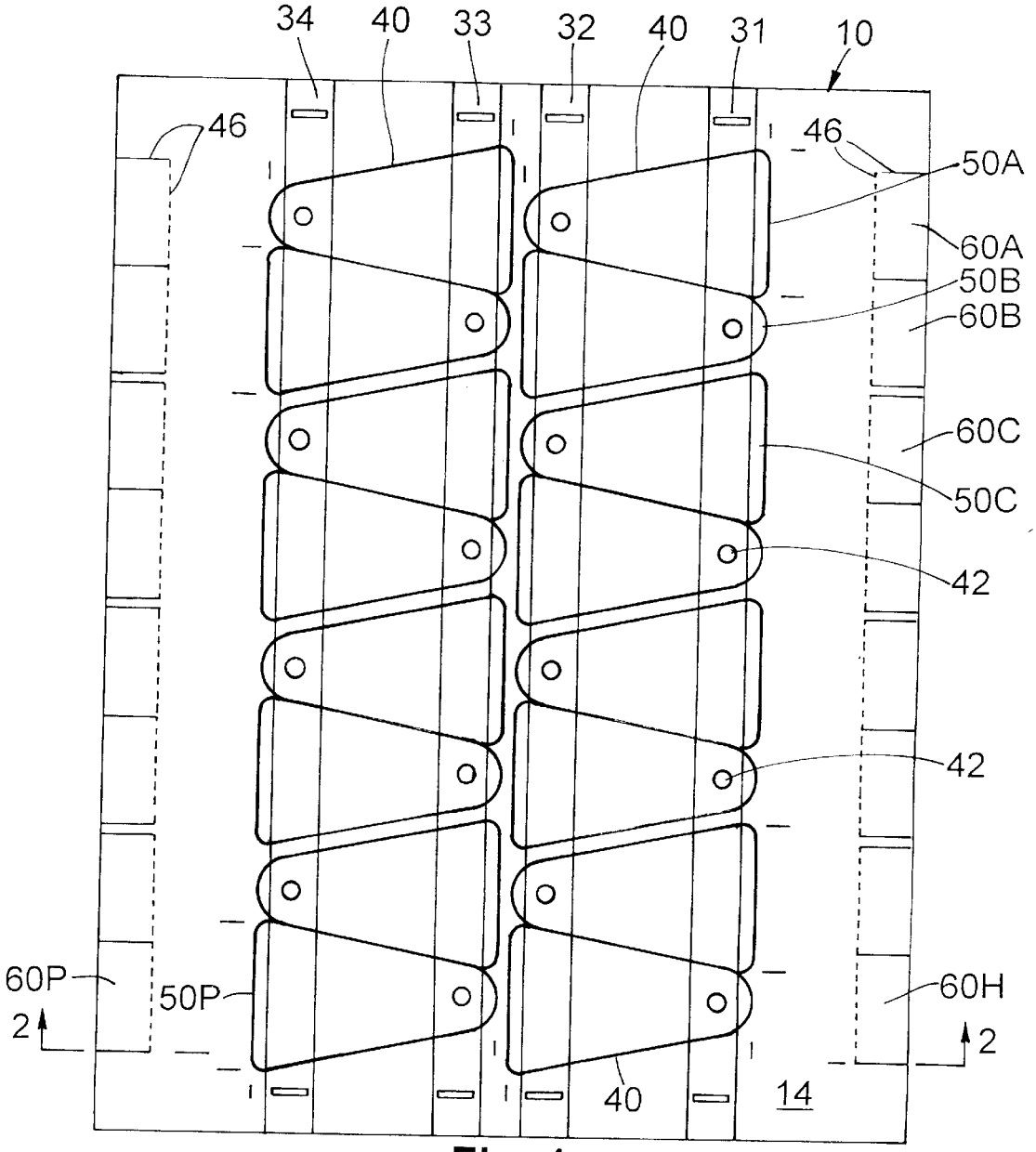
FIG. 1 is a front view of a first printed sheet product according to the present invention.
Figure 2:
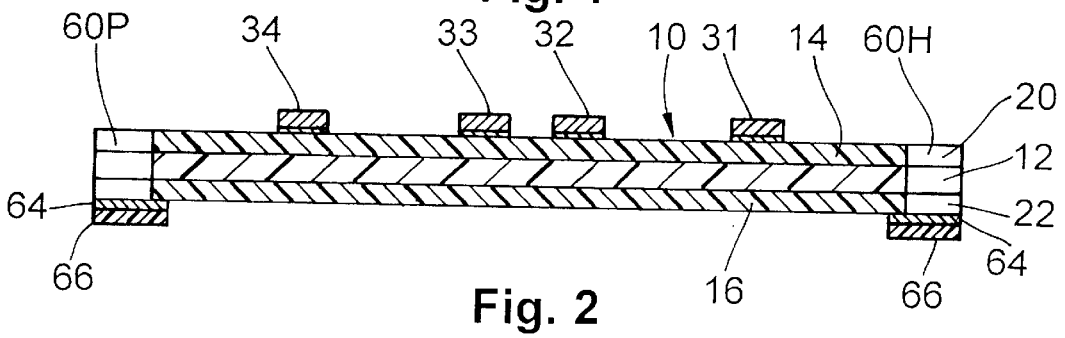
FIG. 2 is a cross section of the sheet product taken along the lines 2—2 in FIG. 1.

In the drawings, like numerals are used to indicate like elements throughout. FIGS. 1 and 2 depict a printed sheet indicated generally at 10. The product comprises a core 12 printable sheet material having a pair of opposing major sides 14 and 16. At least one major side bears printing. Major side 14 seen in FIG. 1 bears printing as will be subsequently described. If desired, either or both of the sides 14 and 16 of the core 12 can be covered with a transparent film layer. A first transparent film layer 20 is shown covering the first side 14 of the core 12 in FIG. 2 while a second transparent film layer 22 covers the second side 16 of the core 12.

A plurality of magnetizable stripes 31–34 are laid down over at least one major side of the core 12 in spaced parallel lines extending preferably entirely across the one major side of the core 12. In the embodiment 10, four magnetizable stripes 31–34 are laid down over the first major side 14 of the core 12 and over the first transparent film cover 20 immediately overlying the core 12.

The sheet product 10 is scored at numerous locations to define various removable elements. Scoring indicated generally at 40 extends sufficiently through the sheet product 10 including the core 10, each transparent film layer 20, 22 if provided and magnetizable stripes 31–34 to define a plurality of tag elements indicated individually at 50A–50P. The tag elements 50A–50P are scored in such a way so as to be realizably retained and removable from the sheet product 10. Scoring 46 along each longitudinal side edge of the generally rectangular sheet product 10 defines an equal plurality of label elements 60A–60P. Labels 60A–60P may be backed by layers 64 of pressure sensitive adhesive and strips 66 of release material.

Figure 3:
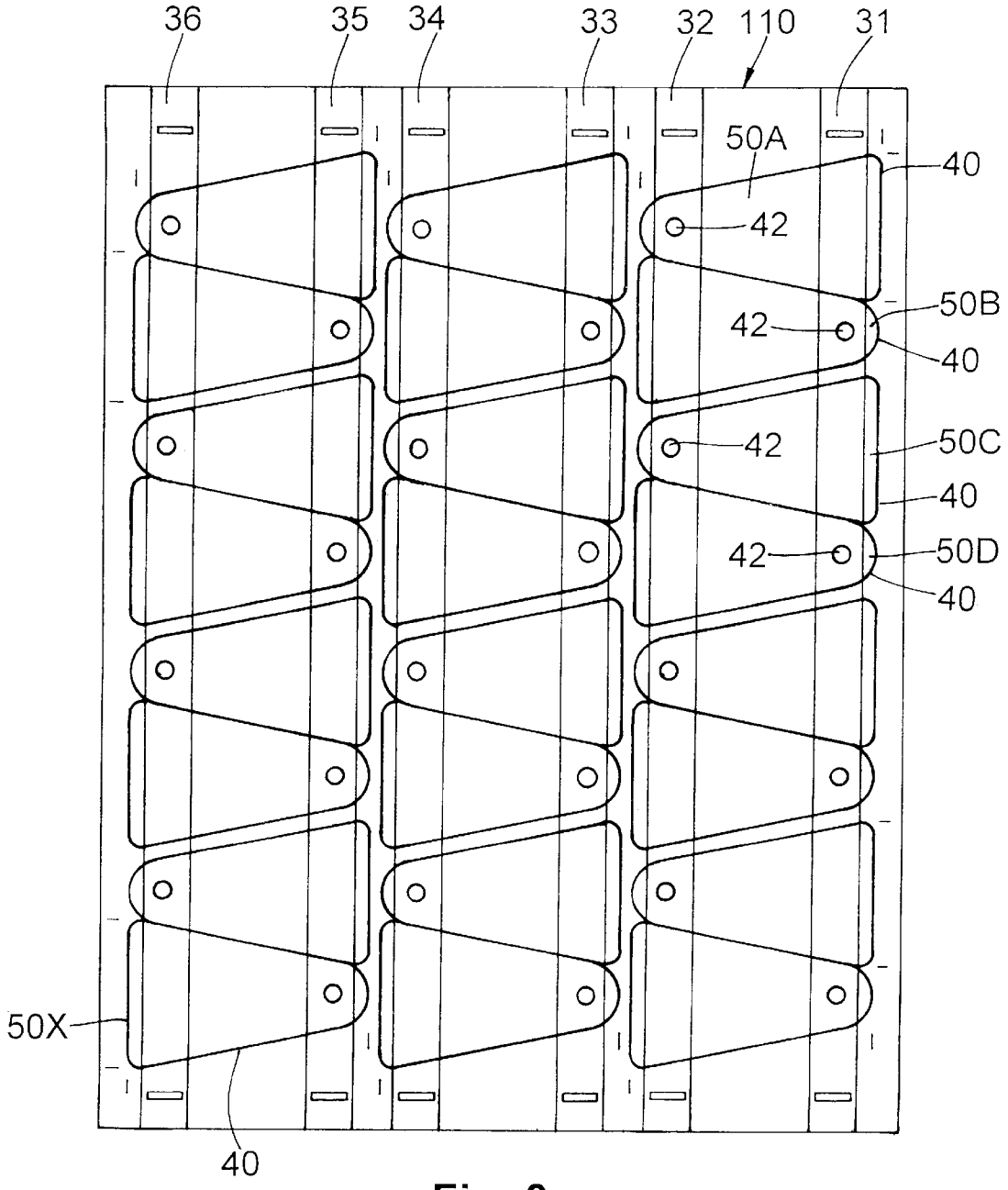
FIG. 3 is a front view of a second sheet product according to the present invention, which is a modification of the first sheet product in FIGS. 1–2.

FIG. 3 depicts a modified sheet product 110 according to the present invention. Instead of plurality of tag elements 50A–50P and label elements 60A–60P, only twenty-four tag element 50A–50X are provided on the sheet product 110 in order to maximize the number of tag elements which may be provided by a sheet product of a given size such as eight and one-half by eleven inches. Forty-eight tag elements could similarly be provided in an eleven by seventeen inch sheet. Also, tag elements with or without labels can be prepared on continuous (roll) core(s) with continuous magnetizable stripes and transparent film layer(s).

Figure 4:
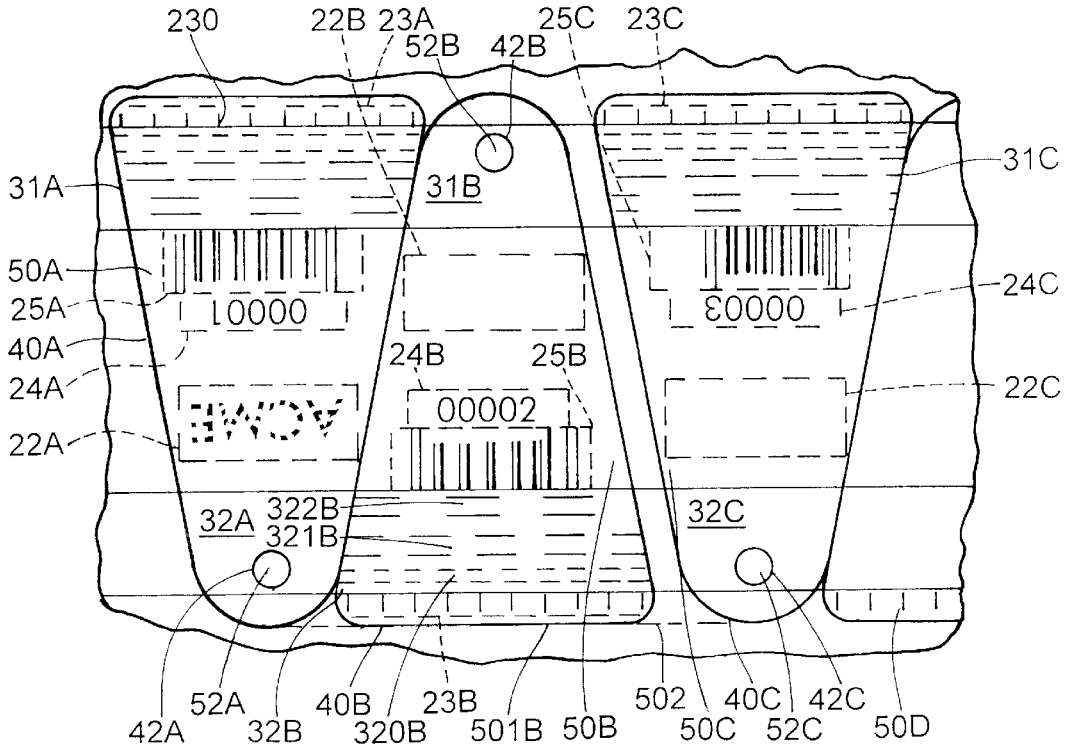
FIG. 4 is a detailed front view portion of identical parts of FIGS. 1 and 3.

FIG. 4 constitutes a greatly expanded detail front view of identical portions of either sheet product 10 or 110. With respect to this part of the description, the sheet products 10, 110 are equivalent. Three adjoining tag elements 50A–50C are shown in their entirety along with a portion of a fourth adjoining tag element 50D.

According to one important aspect of the invention, each sheet product 10, 110 is scored so that each removable tag element 50A–50P or 50A–50X bears part of at least one and, in the depicted embodiments 10 and 110, at least two of the magnetizable stripes 31–34 or 31–36. In particular, for example, tag element 50A bears parts 31A and 32A of magnetizable stripes 31 and 32, respectively. Tag element 50B bears magnetizable stripe parts 31B and 32B. Tag element 50C bears stripe parts 31C and 32C. In addition, each removable tag element 50A–50P or 50A–50X bears printing. If desired, at least part of the printing on each of the removable tag elements is identical to that on each other element of the sheet product 10, 110. Referring to FIG. 4, each of the three depicted elements 50A–50C has a set of four printed fields. First field 22A, 22B, 22C in each tag element 50A–50C, respectively, is identical and may be, for example, a company logo. According to another aspect of the invention, a second, identical printed static graphic field 23A, 23B and 23C is provided on each of the tag elements 50A–50C, respectively. Each static graphic field 23A–23C constitutes a printed set of uniformly spaced timing marks 230, the use of which will be subsequently described. In addition, if desired, one or more variable data fields 24A–24C can also be printed on the sheet product 10 so as to form part of each tag element 50A–50P or 50A–50X.

In FIG. 4, each tag element preferably bears one of the printed variable data fields 24A–24C, each being formed by a set of printed characters which collectively define an alphanumeric code. The printed codes may be unique to each tag element of the sheet product (i.e. different in content from the corresponding printed variable data field of each other tag element of the sheet product) or common to two or more tag elements of the sheet product 10, or 110, depending upon how many tag elements are desired to be distributed to a single person or entity which receives the tag elements.

In FIG. 4, each tag element 50A–50C further preferably bears a second printed variable data field 25A–25C, respectively. Each printed variable data field 25A–25C contains a code in a bar code format. For example, the code encoded in each bar code 25A–25C may be the same unique code printed in the alphanumeric data fields 24A–24C only in bar format or yet another, different code. The codes and thus the printing forming the variable data field 24A, 24B, 24C . . . and 25A, 25B, 25C . . . are typically different from those of all other tag elements of the sheet product 10 or 110 although each printed code field may be different from all but one or two other code fields if two or three tag elements are to be issued to the same individual or entity.

The individual tag elements of the invention are preferably configured so that they may be carried on a key chain or ring or tab or in a key case without remarkable or noticeable difference in size from keys which may be also carried. In order to enable the tag element to be so mounted, scoring indicated generally at 42 in FIGS. 1 and 3 and specifically at 42A, 42B and 42C in FIG. 4 extends sufficiently through the sheet product 10 or 110 including the core 12, first and second transparent film layers 20, 22 and in some cases magnetizable stripes 31–34 or 31–36 to further define an opening 52A, 52B, 52C with a closed perimeter (i.e. hole) within each tag element 50A, 50B, 50C . . . and extending transversely through each removable tag element 50A, 50B, 50C . . . of the sheet product 10 or 110.

At least one of the magnetizable stripe parts provided on each tag element is provided for the purpose of data storage. To that end, at least one magnetizable stripe parts adjoins and extends at least generally in a common direction with one outer edge of each tag element so that magnetizable stripe part can be swept through a conventional magnetic stripe swipe reader/writer. The magnetizable stripe part used for data storage suggestedly has a width of at least one-sixty-fourth of an inch in order to record data which can be read. Preferably, each magnetizable stripe 31–36 has sufficient width to record a plurality of separate data tracks, each of which is readable with a conventional magnetic stripe swipe reader/writer. According to existing, commonly used specifications, magnetic stripes bearing three data tracks are four-tenths of an inch in width, are nominally spaced within about two-tenths of an inch from an adjoining outer edge of the card which is the edge on which the card is supported as it is swiped through a reader. For example, referring to FIG. 4, magnetizable stripe part 32B bears three track areas indicated in phantom at 320B, 321B and 322B. The lower edge of stripe part 32B is located within about two-tenths of an inch from the adjoining or proximal outer edge 501B of the tag element 50B. The first track 320B nominally begins more than one-fifth of an inch and less than one-quarter of an inch and ends no more than one-third of an inch from the proximal outer edge 501B or, more accurately, a tangent 502 to that edge 501B, as the edge 501B need not be straight. The second track 321B nominally begins at slightly more than one-third of an inch from the proximal edge 501B or its tangent 502 and ends less than one-half inch from that edge. The third track 322B nominally begins at about one-half inch and ends six-tenths of an inch from the proximal outer edge 501B or its tangent 502. Thus, all of the tracks 320B, 321B, 322B are located within two-thirds of an inch from the proximal outer edge 501B, two of the tracks 321B and 320B are located within one-half inch of the proximal outer edge 501B while the closest track 320B is located within one-third of an inch of that edge (or its tangent 520 if not straight).

Data is normally recorded at a rate of 150 bits per inch per track. Twenty-five, six-bit characters can be recorded on each track along each one-inch length of the magnetizable stripe part. The longer of the two magnetizable stripe parts on each tag element 50A, 50B is more than an inch long in the depicted embodiments (in comparison to a slightly more than three-inch standard length specified for credit cards) and so can store only about one-third of the magnetic data which is storable on a conventional credit card. This provides the possibility of recording nearly thirty, six bit characters per track 320B–322B.

While all of the printed and magnetizable stripe parts 31A, 32A, etc. are shown in the two depicted embodiments 10 and 110 as being provided on only one side of the sheet product and each tag element, any of the printed fields could be printed on either side or both sides of the sheet product. Similarly, magnetic stripes can be laid over either or both major sides of the sheet product. Thus, each tag element could be provided with two, inch-long, magnetizable stripe parts, one on either side of the tag element.

The printed sets of identical, optical timing marks 23A, 23B, 23C . . . on each tag element 50A, 50B, 50C . . . are provided for use in conjunction with the magnetizable stripe part used for data storage. Each set 50A, 50B, 50C . . . adjoins and extends at least generally in a common direction with the one proximal outer edge 501A, 501B, 501C and is preferably located adjoining at least one of the magnetizable stripe parts 31A, 32B, 31C . . . of the tag elements 50A, 50B, 50C . . . being used for data storage between that one magnetizable stripe part and the adjoining one proximal outer edge 501A, 501B, 501C of the respective tag elements 50A, 50B, 50C . . . .

Each tag element 50A, 50B . . . is preferably generally elongated and no more than about three inches in length and one inch in width so as to reasonably interleave with conventionally sized keys on a key fob, a key chain, a ring or in a key case. The magnetizable stripes 31–34 and 31–36 and the parts of each of those stripes on each tag element 50A–50P or -50X extend generally perpendicularly to the elongated direction of each tag element 50A, 50B . . . .

Figure 5:
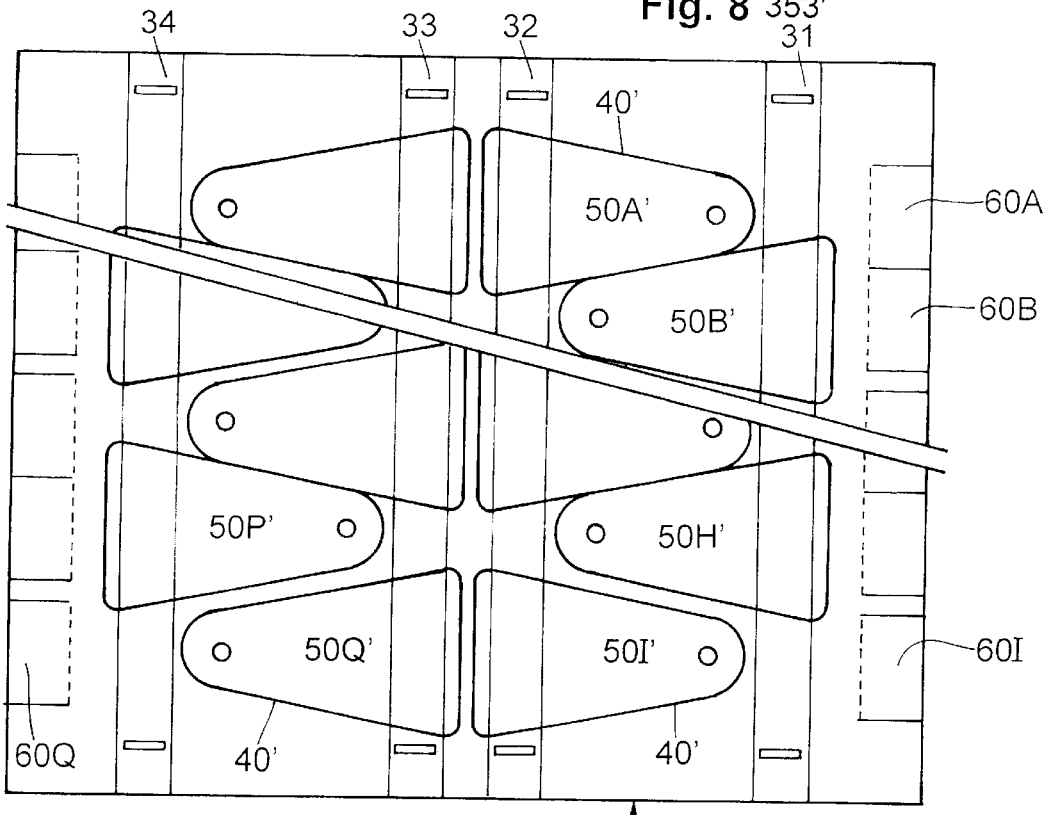
FIG. 5 is a front view of part of a third sheet product with different tag elements.

FIG. 5 depicts a modified version 10' of the sheet product 10 of FIGS. 1 and 2. The components are the same as the sheet product 10 in FIGS. 1 and 2 but the individual scoring 40' defining the plurality of tag elements 50A', 50B' . . . etc. are laterally spaced so that each tag element is only overlapped by one of the magnetizable stripes 31–34.

Figure 6:
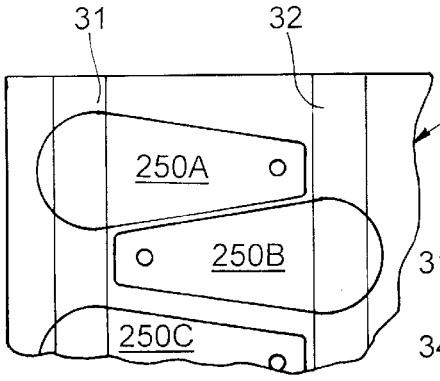
FIG. 6 is a front view of part of a fourth sheet product with different tag elements.

While the tag elements 50A–50X are generally isosceles triangles, they could be of other shapes. For example, FIG. 6 depicts yet another sheet product 210 with generally "tear"-shaped removable tag elements 250A, 250B, . . . and two of a plurality of magnetizable stripes 31, 32. Elements 250A, 250B . . . have been laterally displaced so that only magnetic stripe 31, 32 overlies each tag element. This is possible where label elements are being printed and the full area of the sheet between the longitudinal edges is not filled with tag elements.

Figure 7:
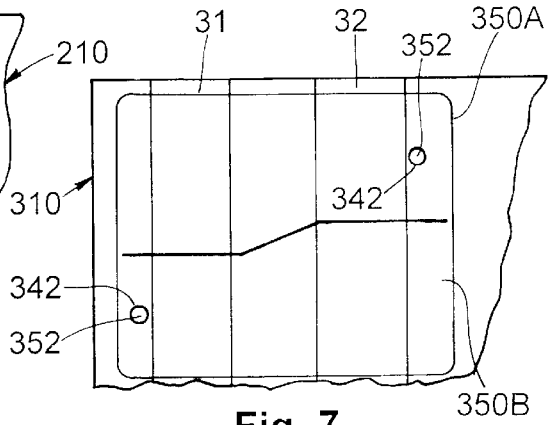
FIG. 7 is a front view of part of a fifth sheet product with different tag elements.

Rectangular tag elements with opposing parallel pairs of straight edges of equal lengths oriented at right angles to one another could be employed but only generally quadrilateral tag elements 350A, 350B . . . of sheet product 310 of FIG. 7 provide a more efficient use of sheet product including asymmetric lengths of parts of the magnetizable stripes 31, 32 . . . , including one longer usable stripe length, for greater data storage than could be achieved with a conventional rectangular shape.

Figure 9:
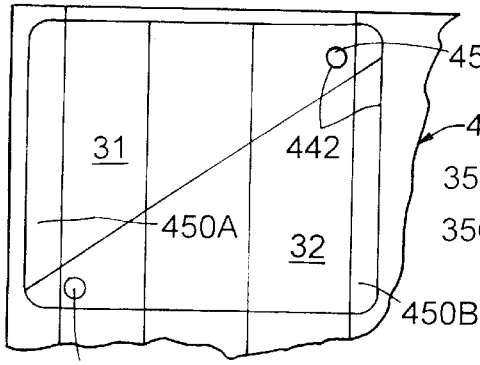
FIG. 9 is a front view of part of a seventh sheet product.
Figure 8:
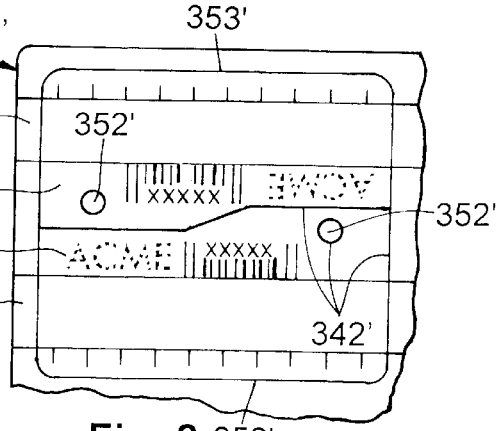
FIG. 8 is a front view of part of a sixth sheet product with different tag elements.

If greater data storage is desired, the magnetizable stripes 31, 32 can be run longitudinally and parallel with the elongated dimension of the removable tag elements. Referring to FIG. 8, sheet product 310' bears tag elements 350A', 350B' . . . having the same asymmetric nearly rectangular shape as tag element 350A, 350B of the sheet product 310 but with magnetizable stripes 31', 32' . . . running parallel to the elongated direction of each removable element 350A, 350B, etc. FIG. 9 depicts yet another sheet product 410 having generally right triangular shaped removable elements 450A, 450B . . . and magnetizable stripes 31, 32 . . . running parallel to one elongated side of each of the triangular tag elements.

Referring particularly to the tags 350, 350' in FIGS. 7 and 8, each is only generally quadrilateral in shape with a width and a length longer than its width. Each removable element 350, 350' has a pair of opposing, spaced apart long sides and a pair of opposing, spaced apart short sides, each of the short sides being shorter in length than each of the long sides. The "width" spacing of the element, between the pair of long sides, changes along the length of each element 350, 350' whereby each element 350, 350' has a narrower width portion and a wider width portion. In FIG. 7, each closed perimeter opening 352 formed by scoring 342 in each element 350 is located in the narrower width portion of each removable element 350A, 350B, etc. In FIG. 8, each closed perimeter opening 352' formed by scoring 342' each removable tag element 350' is located in the wider width portion of the element. Each closed perimeter scored opening 352, 352' is spaced from each data carrying magnetic stripe portion and/or bar code data field printed on each element so as not to damage either or prevent or interfere with their automatic reading or, in the case of the magnetic stripe, writing. For example, where only a single longitudinal magnetic stripe is provided as in FIG. 8, the closed perimeter opening 352' will be located at least one-half inch or more away from the longitudinal edge of the long side 353' of the element 350' across from such magnetic stripe, and at least one inch or more from that edge where a printed bar code variable data field is provided, to enable the element 350' to be read on conventional magnetic stripe and/or bar code read/write heads. It will be appreciated that this spacing can be changed if custom heads are furnished for use with such elements.

Each variation on the shape of the tag elements of this invention are meant to be illustrative and do not constitute a complete set of all possible shapes and sizes. However, the narrowest portion of each tag element should be sufficiently wide to enable any encoding thereon to be machine read, particularly through a swipe reader. That would require a thickness of at least about one inch for a one-dimensional printed bar code or one-half inch for a single track magnetic stripe written by conventional writer equipment. Other dimensions may be or may become possible for different swipe readers which may be developed. Where printed bar codes are employed, the scored, closed perimeter openings should be positioned at least one inch from the outer edge of the tag element proximal to the magnetic stripe part or printed bar code, which would be the outer edge of the tag element inserted through the swipe reader, to avoid passing the closed perimeter opening through the "read"/"write" area of the swipe reader/writer. Moreover, while both the printed bar codes and magnetic stripes are shown on the same side of each core, they can be provided on opposite sides of the core. While the triangular removable elements 50 do not lend to easy subdivision of the sheet products 10, 10' or 100, the more rectangularly arranged removable elements 350, 350' and 450 of sheet products 310, 310' and 410 in FIGS. 7–9, respectively do lend to subdivision of the sheet products into smaller sheet products including at least one of the pairs of the removable elements, which would be identically or essentially identically encoded for transfer to a single individual. Also the number of labels provided for each tag element or set of tag elements can be varied. For example, pairs of tag elements can be provided with none, one, two or even four (i.e., 2 labels from each of two rows) or more labels.

The core 12 of each sheet product 10, 10', 110, etc. can be any thin sheet or web material having two major planar opposing sides, which can be printed upon. Preferably, the core is a flexible material which can be used with conventional, high speed offset printing machines. Acceptable materials include metal foils, cellulose based products, fabrics, cloths and preferably plastics including, for example, ABS, acetates, butyrate, phenolic, polycarbonates, polyesters, polyethylenes, polypropylenes, polystyrenes, polyurethanes and polyvinyl chlorides as monomers, copolymers and/or laminates. For example, the following specific trademarked products may be useful: Polyart I and II of Arjobex Synthetic Papers; various grades of GP700 from Bexford Limited (Engl.); Kapton, Tedlar and Telar of DuPont; Fascal, Fasprint and Crack n' Peel Plus of Fasson; Lasercal, Compucal II and Datacal Coating of Flexcon; Kimdura of Kimberly Clark; various grades of Pentaprint PR of Klockner Pentaplast; various grades of LLM-LV and Data Graphic II LLM of Lamart; Teslin of PPG Industries; the following products of Stanpat: APL-100, -110, -120, -150, -200, UM-546, UC-546, PPC-410, -450 and -460; and the following products of Transilwrap: Proprint, Transilprint, Transilmatte, T.X.P., Eve, Trans-Alley, Transglaze, Trans-AR, Trans V.L. and T Print; and others. These brand name products are treated or constructed in some fashion to make them particularly suited for use in one or more types of printing processes. Details regarding these products and companies and others are available to those of ordinary skill in the art through various sources including but not limited to published references such as *AUTOMATED ID NEWS* 1996–1997 *REFERENCE GUIDE AND DIRECTORY*, published and distributed by Advanstar Communications, Cleveland, Ohio.

Each of the first and second transparent film layers 20 and 22 can be any material which is suitably and sufficiently transparent and which can be applied to the core material selected in any suitable fashion for the material(s) selected without adversely affecting the core or the printing thereon. The coverings might be, for example, sheets or webs of any of a variety of transparent Transcote FG and Copolymer plastic films of Transilwrap, Inc. of Chicago, Ill., which are transparent in at least the visible and infrared light spectrums or any of a variety of similarly transparent Durafilm plastic films of Graphic Laminating, Inc. of Cleveland, Ohio. The plastic films are preferably adhered to the core with an adhesive appropriate for use with the materials selected for the core and transparent covering. Typically, polymer based adhesives are used with the exemplary plastic films identified above.

In addition, such laminate films can be obtained from various commercial sources incorporating one or more magnetizable (magnetic) stripes, of the type found on most common credit cards. For example, JCP Enterprise Inc. of Gardnerville, Nev. 89410 can supply a transparent polyester sheet bearing a heat-activated permanent adhesive on one side and one or more magnetic stripes mounted to the other side with a UV cured resin. The resin further forms a thin (about 40 to 70 microns), protective, transparent layer over the magnetic stripes, which does not interfere with reading or writing data on the stripes. Another source of magnetic stripe material is Transilwrap Company, Chicago, Ill. Alternatively, separate magnetic stripes can be applied to the transparent covering in a conventional manner for such materials, such as by hot stamping.

For the particular removable tag elements being made in the embodiments disclosed in this application, the above-identified coverings are preferred, as they provide a layer of polyester having good strength, wear and soil resistant properties which can be used on the outer side of the sheet products 10, 10', 110, etc. The pressure sensitive adhesive used may be any conventional, commercially available, pressure sensitive contact adhesive suitable for use with the particular materials selected for the sheet product. For the embodiments being described, double coated, permanent adhesive transfer tapes, such as those available from Enterprise Tape Company of Dalton, Ill., for example, are suitable.

The preferred methods of manufacturing the preferred sheet products 10, 10', 100, etc. are quite similar and straightforward. Preferably, the static graphic fields are printed first on each selected side of the core material selected. Any known, conventional type of printer and printing process may be used including, for example, flexographic, offset lithographic, silkscreen, letter press, thermal transfer, thermal direct, ink jet, color laser, formed character impact, hot stamp, electrostatic, ion deposition, magneto graphic, dot matrix, cycolor, photographic silver halide, sublimation, diffusion, pad, gravure, spray painting, dyeing, electrolytic plating, electroless plating, sputter deposition, in-mold decorating, flocking, embossing, vacuum evaporation metallizing, engraving, hot transfer, electro-photographic printing or electro ink printing process. Preferably, a high speed printing process such as flexographic or offset lithography is used to print on continuous webs of thin flexible planar material for efficiency and cost. A printing method and machine capable of simultaneously printing the first and second sets of static graphic fields on the first and second sides of the web in one pass through the printer is preferred for efficiency, but single side printing in separate passes may be preferred for quality.

Next, the core bearing the printed static graphic fields preferably is passed through a variable data field printer, preferably a programmable printer capable of printing variable data fields in at least bar and character format on at least one side of the core, which becomes the first side of the sheet products, in a single pass of the core through that printer. "Character" encompasses at least alphanumerics and conventional punctuation symbols. Commercially available printers having this capability include thermal transfer, thermal direct, ink jet, color laser, formed character impact, electrostatic, ion deposition, magnetographic, dot matrix, photographic and sublimation and are available from almost an innumerable list of suppliers. Again, printers printing on continuous webs are preferred for efficiency but printers printing on individual sheets (cut lengths of web) are preferred for quality. Currently, thermal transfer and laser printers are preferred in the industry for variable format printing, particularly of characters and bar codes. Generally speaking, existing thermal transfer printers provide high quality, sharp characters and bars while laser printers provide characters and bars which are not as sharp but more consistent in thickness. Improvements continue to be made to both ink jet and ion deposition printers as well. Ink jet and/or ion deposition printers may be preferred for speed. However, at least currently available machines, generally speaking, do not provide the quality provided by currently available thermal transfer and laser printers. Currently, laser printing is preferred for the particular embodiments 10 and 110 being described. For example, laser printers are made and/or distributed in the United States by such well-known corporations as Hewlett-Packard, IBM, Kodak, NCR, Panasonic, Pentax, Ricoh, Siemans, Toshiba and Xerox. In addition, literally dozens of other, smaller manufacturers offer programmed or programmable printers which can be used or can be configured to be used to perform the steps indicated above. Again, the material selected for the core 12 should be compatible with the preferred printing method and equipment or the printing methods and equipment selected to be compatible with a preferred material. For example, for laser printing, a micro voided polysilicate plastic sheet material, having, at least about sixty percent porosity like PPG Industries Teslin™ is preferred.

The programmable code field printer selected preferably is configured to print each of the variable data fields. With respect to sheet products 10, 110, the first plurality of variable data code fields including 23B and/or 24B 20*a*–27*a* are printed in a landscape mode running vertically, parallel to the side edges of the sheet 10. This is accomplished in a straightforward fashion by simply programming the computer to identify the characters to be printed at predetermined locations on the web in defined angular orientations to the web. In this way, all of the code fields are printed on the web in a single pass of the web through the printer. Preferably, the first and second transparent layers 20 and 22 are then applied to the opposing sides 14 and 26 of the web in a conventional manner for the covering material selected. The magnetizable stripes may be applied with a pressure sensitive adhesive backing to a transparent layer after that layer has been applied to the core or the magnetic stripe can be provided laminated to a transparent film layer and that laminate attached to the core. The stripes of pressure sensitive adhesive 60 and 64 are also applied, with or without release paper 62 and 66, respectively, for the embodiment 10, 100 or 110 selected.

Separate printing of static graphic and variable data fields is presently preferred for speed, cost and quality. However, the capabilities of programmable printers continues to improve in all three categories. In some instances, it is already possible to simultaneously print certain types of static graphic and variable data fields at the same time using the same programmable printer in a single pass of the core through the printer. Duplex printers are now becoming available which permit the printing of static graphic and variable data fields on both sides of a core in a single pass through such printers, for example, printers from INDIGO of Maastricht, The Netherlands or its U.S. subsidiary, Indigo America in Woburn, Mass. Sheet products printed by such devices are intended to be encompassed by the present invention. The present invention is also intended to cover all instances where static graphic fields may be printed before, after or simultaneously with the variable data fields on one or both sides of a continuous or cut length core.

Next, if the first embodiment sheet product 10 is produced, the printed, covered web is preferably fed through a cutter which scores the sheet product 10 through the core 12, layers 20 and 22, magnetizable stripes 31–34 or 36 and stripes 60 and 64, where present, to define the sets of removable tag elements 50A–50P or -50X, respectively and cuts a continuous web into the individual sheet product lengths if a continuous web is used.

One of ordinary skill will appreciate that the order in which certain steps are taken may be immaterial. For example, while printing a static graphic field initially on a continuous web is preferred for rapid, inexpensive printing, static fields can be printed directly on cut sheets. Typically, it will also be immaterial whether the code fields are printed before, after or during the printing of the static graphic fields. Further, the order in which coverings are applied is generally not critical, and coverings could be applied to one side of a core after printing upon that side is completed and before printing is performed on the other side of the core.

Next, one of ordinary skill should be aware that it is now also possible to first laminate a tough, protective transparent film of vinyl or polyester to a relatively inexpensive core of PVC or other inexpensive backing or stock material and print variable data (and/or static graphic) fields directly onto the vinyl or polyester laminate layer. Smudge resistant, scratch resistant, high resin thermal transfer films now available from such manufacturers as Sony and Ricoh are or can be used without a protective film covering. The invention is intended to cover such sheet products as well. In such instances, the core will actually be a laminate.

Applicant's prior U.S. Pat. Nos. 4,978,146 and 5,495,981 are incorporated by reference herein in their entirety for further details regarding such sheet products.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A printed sheet product comprising:

a core of printable sheet material having a pair of opposing major planar sides, at least one major side bearing printing;

a plurality of magnetizable stripes laid down over at least one major side of the core in spaced parallel lines extending across the one major side of the core;

scoring extending sufficiently through the sheet product including the core and each of the magnetizable stripes to define a plurality of tag elements removable from the sheet product, each tag element bearing part of at least one of the magnetizable stripes and printing;

a portion of the printing on each of the removable tag elements being identical to printing on each other tag element of the sheet and another portion of the printing of each tag element being different from the printing on at least one other tag element of the sheet.

2. The printed sheet product of claim 1 wherein scoring further defines an opening with a closed perimeter within each tag element and extending transversely through each removable tag element of the sheet product.

3. The printed sheet product of claim 1 wherein each removable tag element includes a set of printed optical timing marks adjoining and extending along at least one of the magnetizable stripe parts on the tag element.

4. The printed sheet product of claim 3 wherein the at least one magnetizable stripe part adjoins and extends at least generally in a common direction with one outer edge of the tag element and wherein the timing marks are located between the one magnetizable stripe part and the one outer edge of the tag element.

5. The printed sheet product of claim 1 wherein each removable tag element of the sheet product has a magnetizable stripe part located at least within two-thirds of an inch of a tangent to a proximal edge of the tag element extending parallel to the stripe part.

6. The printed sheet product of claim 5 wherein the part of at least one magnetizable stripe is located within one-half of an inch from the tangent to the proximal edge of the tag element.

7. The printed sheet product of claim 5 wherein the part of at least one magnetizable stripe is located within one-third of an inch from the tangent to the proximal edge of the tag element.

8. The printed sheet product of claim 1 wherein each tag element is elongated and wherein the part of each magnetizable stripe on each tag element is elongated in a direction generally perpendicular to the elongation of the tag element.

9. The printed sheet product of claim 1 being no more than eight and one-half by eleven inches in size and containing at least twenty-four removable tag elements.

10. The printed sheet product of claim 1 wherein at least part of the printing on each tag element is machine readable code.

11. The printed sheet product of claim 1 wherein the core is opaque and further comprising a first transparent film layer attached to and overlying a first major planar side of the core.

12. The printed sheet product of claim 11 further comprising a second transparent film layer attached to and overlying a second major planar side of the core and each magnetic stripe overlying at least core.

13. A printed sheet product comprising:

a core of printable sheet material having a pair of opposing major planar sides, at least one side bearing printing;

a plurality of magnetizable stripes laid down over at least one major side of the core in spaced parallel lines extending across the one major side of the core;

scoring extending sufficiently through the sheet product including the core and each of the magnetizable stripes to define a plurality of tag elements removable from the sheet, the plurality of tag elements being of an at least similar shape, each tag element bearing at least part of at least one of the magnetizable stripes and part of the printing, and the scoring further defining an opening with a closed perimeter extending transversely through each removable tag element of the sheet.

14. The printed sheet product of claim 13 wherein one magnetizable stripe part on each tag element adjoins and extends longitudinally at least generally in a common direction with at least one outer edge of the tag element and wherein the magnetizable stripe part is located between the opening with closed perimeter and the one outer edge of the tag element.

15. The printed sheet product of claim 14 wherein each removable tag element includes a set of printed optical timing marks along the tag element adjoining at least one of the magnetizable stripe parts on the tag element.

16. The printed sheet product of claim 13 wherein each removable tag element bears parts of two of the magnetizable stripes.

17. The printed sheet product of claim 16 wherein each of the removable tag elements is other than rectangular in shape lacking a first pair of opposing parallel sides of equal length and a second, separate parallel sides of equal length perpendicular to the first pair of sides.

18. A printed sheet product comprising:

a core of printable sheet material having a pair of opposing major planar sides, at least one major side bearing printing;

a plurality of magnetizable stripes overlying at least one major side of the core in spaced parallel lines extending entirely across the one major side of the core;

scoring extending sufficiently through the sheet product including the core and each of the magnetizable stripes to define a plurality of separate, individual tag elements removable from the sheet, the plurality of tag elements being of an at least similar shape other than at least generally rectangular, each tag element bearing at least part of at least one of the magnetizable stripes and part of the printing, the printing on each removable tag element including at least a machine readable code and the codes printed on the plurality of tag elements removable from the sheet product being different on at least two of the tag elements of the plurality.

19. The sheet product of claim 18 wherein the scoring further defines an opening with a closed perimeter extending transversely through each removable tag element of the sheet product.

20. The printed sheet product of claim 18 wherein each removable tag element includes a plurality of printed optical timing marks adjoining and extending along at least one magnetizable stripe part on the tag element.

21. The printed sheet product of claim 20 wherein the one magnetizable stripe part adjoins and extends at least generally in a common direction with at least one outer edge of the tag element and wherein the timing marks are located between the magnetizable stripe part and the one outer edge of the tag.

22. A printed sheet product comprising:

a core of printable sheet material having a pair of opposing major planar sides, at least one major side bearing printing in the form of a plurality of sets of printed fields;

scoring extending through the sheet product sufficiently to define at least a plurality of elements removable from the sheet product, each removable element including a set of the printed fields;

each removable element of the plurality being only generally quadrilateral in shape with a width and a length longer than the width, each removable element having a pair of opposing, spaced apart long sides and a pair of opposing, spaced apart short sides, each of the short sides being shorter in length than either of the long sides, spacing between the pair of long sides changing along the length of the element whereby each element has a narrower width portion and a wider width portion; and the scoring further defining a closed perimeter opening through each removable element, the closed perimeter opening in each removable element being located more than one-half inch from at least one of the sides of the element.

23. The printed sheet product of claim 22 further comprising a plurality of magnetizable stripes overlying at least one major side of the core in spaced parallel lines extending across the one major side of the core, each magnetizable stripe being spaced from each of the closed perimeter openings of the removable elements.

24. The printed sheet product of claim 22 wherein each of the removable tag elements bears a printed code, each printed code being spaced from each of the closed perimeter openings of the removable elements.

25. The printed sheet product of claim 24 wherein the printed codes of the sheet product on at least two of the removable elements are different.

* * * * *